US006874177B2

(12) United States Patent
Hsia

(10) Patent No.: US 6,874,177 B2
(45) Date of Patent: Apr. 5, 2005

(54) BABY FURNITURE

(76) Inventor: Ben Ming Hsia, 10671 Lanark St., Sun Valley, CA (US) 91352

( * ) Notice: Subject to any disclaimer, the term of this patent is extended or adjusted under 35 U.S.C. 154(b) by 0 days.

(21) Appl. No.: 10/436,179

(22) Filed: May 12, 2003

(65) Prior Publication Data

US 2004/0187207 A1 Sep. 30, 2004

Related U.S. Application Data

(60) Provisional application No. 60/456,464, filed on Mar. 24, 2003.

(51) Int. Cl.[7] ..... A47D 13/06

(52) U.S. Cl. ..... 5/93.1; 5/97; 5/98.1

(58) Field of Search ..... 5/93.1, 97, 98.1

(56) References Cited

U.S. PATENT DOCUMENTS 3,813,703 A * 6/1974 Beaudin, Jr. ..... 4/487
4,715,074 A * 12/1987 Wallace et al. ..... 5/93.1
5,963,996 A * 10/1999 Hsia ..... 5/99.1

* cited by examiner

*Primary Examiner*—Michael F. Trettel
*Assistant Examiner*—Fredrick Conley
(74) *Attorney, Agent, or Firm*—Raymond Y. Chan; David and Raymond

(57) ABSTRACT

A baby furniture includes a boundary frame, a body supporting member spaced apart with the boundary frame, and a plurality of supporting legs connected the boundary frame with the supporting member. A boundary shelter is supported by the boundary frame to surround an interior space within the supporting legs and define a play yard cavity within the supporting legs at a position above the body supporting member and a bassinet cavity within the supporting legs at a position below the body supporting member. Therefore, the baby furniture functions as a play yard when an opening of the play yard cavity faces upwardly and as a bassinet when an opening of the bassinet cavity faces upwardly by flipping the baby furniture in an up side down manner.

15 Claims, 4 Drawing Sheets

BABY FURNITURE

CROSS REFERENCE OF RELATED APPLICATION

This is a regular application of a provisional application, application No. 60/456,464, filed on Mar. 24, 2003.

BACKGROUND OF THE PRESENT INVENTION

1. Field of Invention

The present invention relates to furniture, and more particularly to baby furniture which comprises a portable bassinet which is incorporated with a play yard wherein a user can be able to selectively, depending on the age of his/her child, utilize the baby furniture as a bassinet or a play yard.

2. Description of Related Arts

Play yards and bassinets have widely been used by parents for their minors. Play yard is used to restrict the movement of a baby who is able to trail or walk when the parents cannot always keep their eyes on their babies. In order to save space for travel and storage, most of the play yards incorporate with a foldable mechanism to reduce its size.

Traditional foldable play yard comprises a foldable frame having a plurality of joints pivotally connecting with a plurality of supporting rods to form an open box structure, so that a baby can be put inside a cloth made boundary to restrict his or her movement.

On the other hand, because strollers are generally not suitable for carrying infant in that vibrations may make the infant uncomfortable and subject to high risk of injury. Thus, bassinets are generally used for carrying infant.

Conventional bassinet generally comprises a fabric made basin having a compartment to receive the infant therein, and a supporting frame for supporting the basin.

In regard to these two 'traditional instruments', they are generally fine. But those who do have an infant at home would find that infant's furniture become outdated or obsolete quickly, because of the rapid growth of their infants. For example, bassinets are generally suitable only for baby, while play yards are generally suitable only for older minors—here, 'older' is denoted with respect to baby. What's even worse, as a matter of fact, generally speaking, equipments for minors are far from cheap. Given the need of frequent replacements, the burden on those families which have one or more infants are considerable. This is especially true for low-wealth families.

On the other hand, those rapidly outdated infants' equipments can also bring considerable problems to the families in terms of their proper storage and transportation. Bassinets and play yards are usually bulky and occupy considerable amount of space in the parents' room. When bassinet is no longer suitable, parents may buy a play yard in replacement, thus leaving the bulky bassinet empty. In case the bassinet is not of foldable type, the parents have no option but to keep it elsewhere or simply to dump it. At that time, the bassinet may have been used only for a very short period of time, such as few months. Thus, one can see, traditional infant equipments, due to their very purpose, easily result in substantial waste of both resources and money.

SUMMARY OF THE PRESENT INVENTION

A main object of the present invention is to provide baby furniture which comprises a bassinet and a play yard incorporated with each other wherein user of the present invention is able, depending on the age of the child, to selectively utilize the baby furniture as a bassinet or a play yard.

Another object of the present invention is to provide baby furniture which is adapted for use as either a bassinet or a play yard, and capable of folding into a compact structure when it is not in use, so that it is easy to transport and storage.

Another object of the present invention is to provide baby furniture comprising a bassinet and a play yard incorporated with each other, wherein the transverse area occupied by the baby furniture as a whole does not significantly greater than that of each of the bassinet and the play yard, so that user of the present invention needs not allocating more space for the present invention.

Another object of the present invention is to provide baby furniture which does not significantly alter the original structure and design of the either the bassinet and the play yard.

Another object of the present invention is to provide baby furniture which does not involve complicated mechanical structure so as to minimize the manufacturing and related cost of the present invention.

Another object of the present invention is to provide baby furniture which comprises a bassinet and a play yard prolonging the life span of either conventional bassinets and play yards which are both only suitable for infants of a particular short range of age.

According, in order to accomplish the above objects, the present invention provide baby furniture, comprising:

a boundary frame comprising a plurality of head joints;

a body supporting member, which is spaced apart from the boundary frame, comprising a plurality of mounting devices aligned with the head joints respectively;

a plurality of supporting legs each having a first end fastened with the respective head joint and an opposed second end, wherein the mounting devices are mounted to the supporting legs respectively to form a play yard portion of each of the supporting legs defined between the first end thereof and the mounting device and a bassinet portion of each of the supporting legs defined between the second end thereof and the mounting device; and a boundary shelter supported by the boundary frame to surround an interior space within the supporting legs and define a play yard cavity and a bassinet cavity, wherein the play yard cavity is formed within the boundary shelter, the play yard portions of the supporting legs and the body supporting member, wherein the bassinet cavity is formed within the boundary shelter, the bassinet portions of the supporting legs and the body supporting member, wherein a depth of the play yard cavity is larger than that of the bassinet cavity, in such a manner that the baby furniture functions as a play yard when an opening of the play yard cavity faces upwardly and as a bassinet when an opening of the bassinet cavity faces upwardly by flipping the baby furniture in an up side down manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
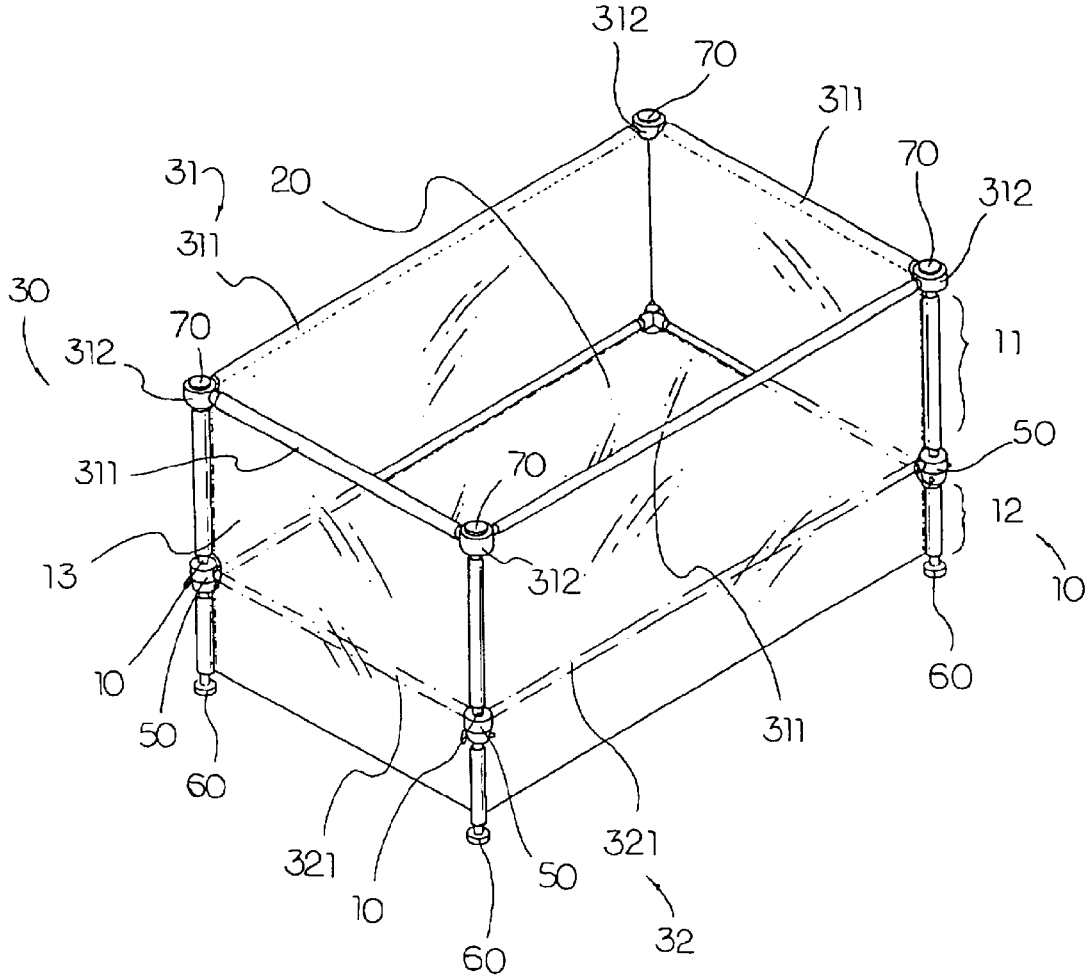
FIG. 1 is a perspective view of a baby furniture according to a preferred embodiment of the present invention.

Referring to FIG. 1 of the drawings, a kind of baby furniture according to a preferred embodiment of the present invention is illustrated. According to the preferred embodiment, the baby furniture 1 comprises four supporting legs 10 adapted to be spacedly erected on a flat ground, wherein each of the supporting legs 10 has a play yard portion 11 and a bassinet portion 12.

The baby furniture further comprises a body supporting member 20 transversely provided between the four supporting legs 10 so as to divide each of the supporting legs 10 into the upper play yard portion 11 and the lower bassinet portion 12, so as to define an upper play yard cavity between the four upper play yard portions 11 of the supporting legs 10 and an upper side of the body supporting member 20, and a lower bassinet cavity between the lower bassinet portions 12 of the supporting legs 10 and a lower side of the body supporting member 20.

According to the preferred embodiment, the body supporting member 20 can embodied as a flat rectangular panel made of light yet rigid and strong material and horizontally provided between the four supporting legs 10 so as to provide sound support to the baby furniture comprises a play yard frame 30 and a bassinet frame 40 which are supported in the play yard cavity and the bassinet cavity respectively.

The baby furniture of the present invention further comprises means 50 for mounting the four supporting legs 10 to the furniture frame, wherein the baby furniture is adapted for using as a play yard and a bassinet being uprightly reversed.

Figure 2:
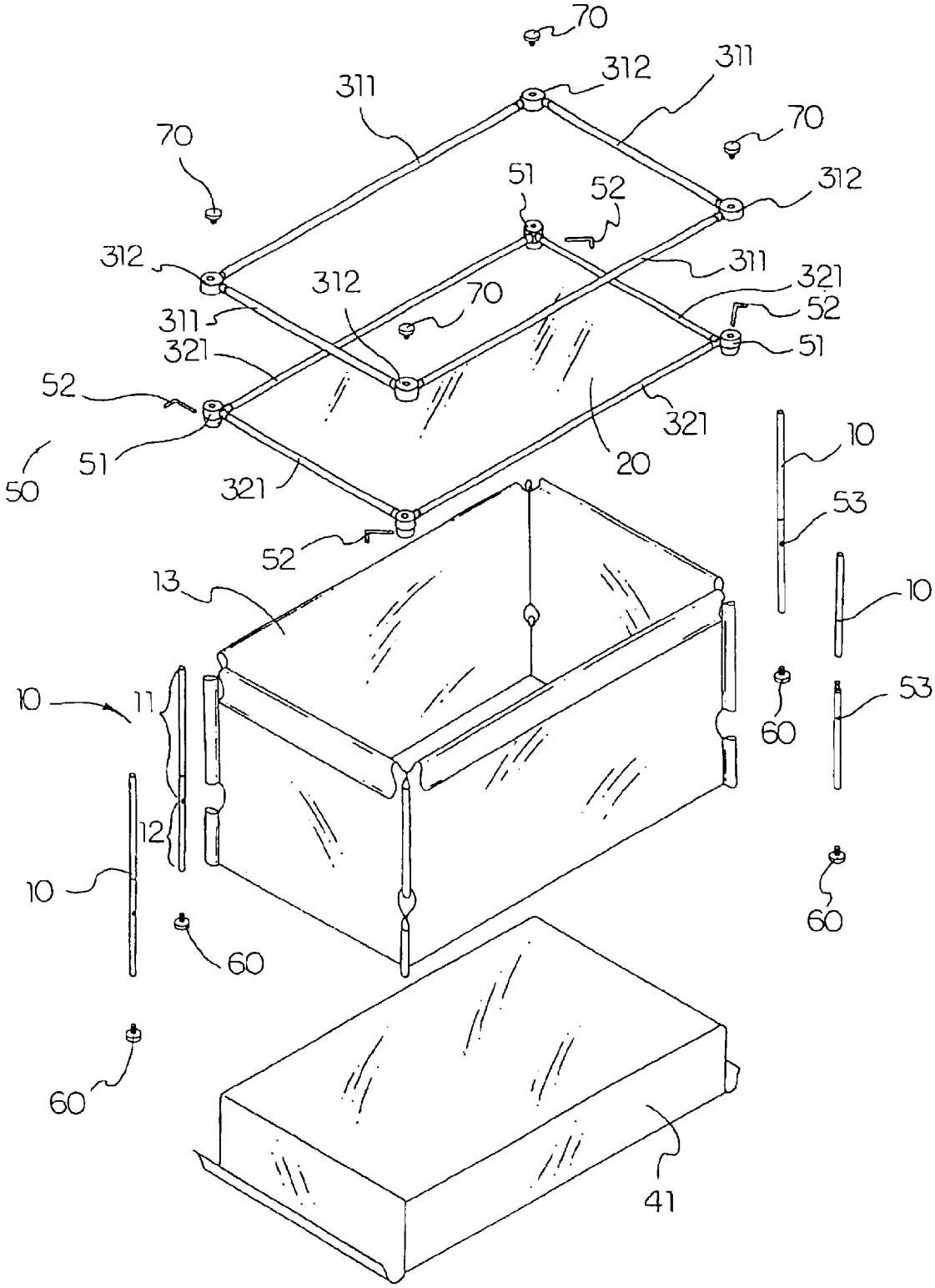
FIG. 2 is a partially exploded perspective view of the baby furniture according to the above preferred embodiment of the present invention, illustrating the structure of the play yard.

Referring to FIG. 2 of the drawings, the play yard frame 30 comprises a boundary frame 31 and a surrounding frame 32 as a second boundary frame to mount the body supporting member 20 to the supporting legs 10, wherein the boundary frame 31 comprises two pairs of upper construction posts 311 connected with each other in an end-to-end manner through four head joints 312 respectively to form a quadrilateral boundary frame. According to the preferred embodiment, the boundary frame 31 is a rectangular boundary frame having substantially the same dimension as the body supporting member 20. Similarly, the surrounding frame 32 comprises two pairs of lower construction posts 321 connected together again in an end-to-end manner to form a rectangular second boundary frame 32 wherein the mounting means 50 are spacedly provided at the surrounding frame 32 at four comers thereof such that the body supporting member 20 is supported by the surrounding frame 32 at a position spaced apart from the boundary frame 31 to provide a body supporting surface within the surrounding frame 32. Accordingly, the body supporting member 20 is preferred to be made of lightweight and durable fabric material, such as mesh fabric or nylon, such that when the body supporting member 20 is mounted on the surrounding frame 32, the body supporting member 20 provides a tension surface as the body supporting surface for supporting a downward force of a baby user's weight exerted on the body supporting member 20.

In other words, a boundary shelter 13 is supported by the boundary frame 31 to surround an interior space within the supporting legs 10 and define the play yard cavity and the bassinet cavity. The play yard cavity is formed within the boundary shelter 13, the play yard portions 11 of the supporting legs 10 and the body supporting member 20. The bassinet cavity is formed within the boundary shelter 13, the bassinet portions 12 of the supporting legs 10 and the body supporting member 20. A depth of the play yard cavity is larger than that of the bassinet cavity, in such a manner that the baby furniture functions as a play yard when an opening of the play yard cavity faces upwardly and as a bassinet when an opening of the bassinet cavity faces upwardly by flipping the baby furniture in an up side down manner. Preferably, the play yard cavity has the depth at least 22 inches and the bassinet cavity has the depth at least 7 inches.

In addition, when the baby furniture is used as the play yard, the boundary frame 31 functions as a top boundary opening rim of the play yard cavity to substantially restrict a movement of an older baby within the play yard cavity wherein the first peripheral edge of the boundary shelter 13 is firmly attached to the boundary frame 31. When the baby furniture is flipped up side down to function as the bassinet, the opposed second peripheral edge of the boundary shelter 13 functions as the boundary opening edge of the bassinet cavity. Since a predetermined tensional force is applied on the boundary shelter 13 through the supporting legs 10, the second peripheral edge of boundary shelter 13 is tensely stretched and should be strong enough to restrict a movement of a younger baby within the bassinet cavity. It is worth to mention that an additional boundary frame can be mounted to the second ends of the supporting legs 10 such that the second peripheral edge of the boundary shelter 13 is firmly attached to the additional boundary frame to form a rigid boundary rim for the bassinet.

Figure 3:
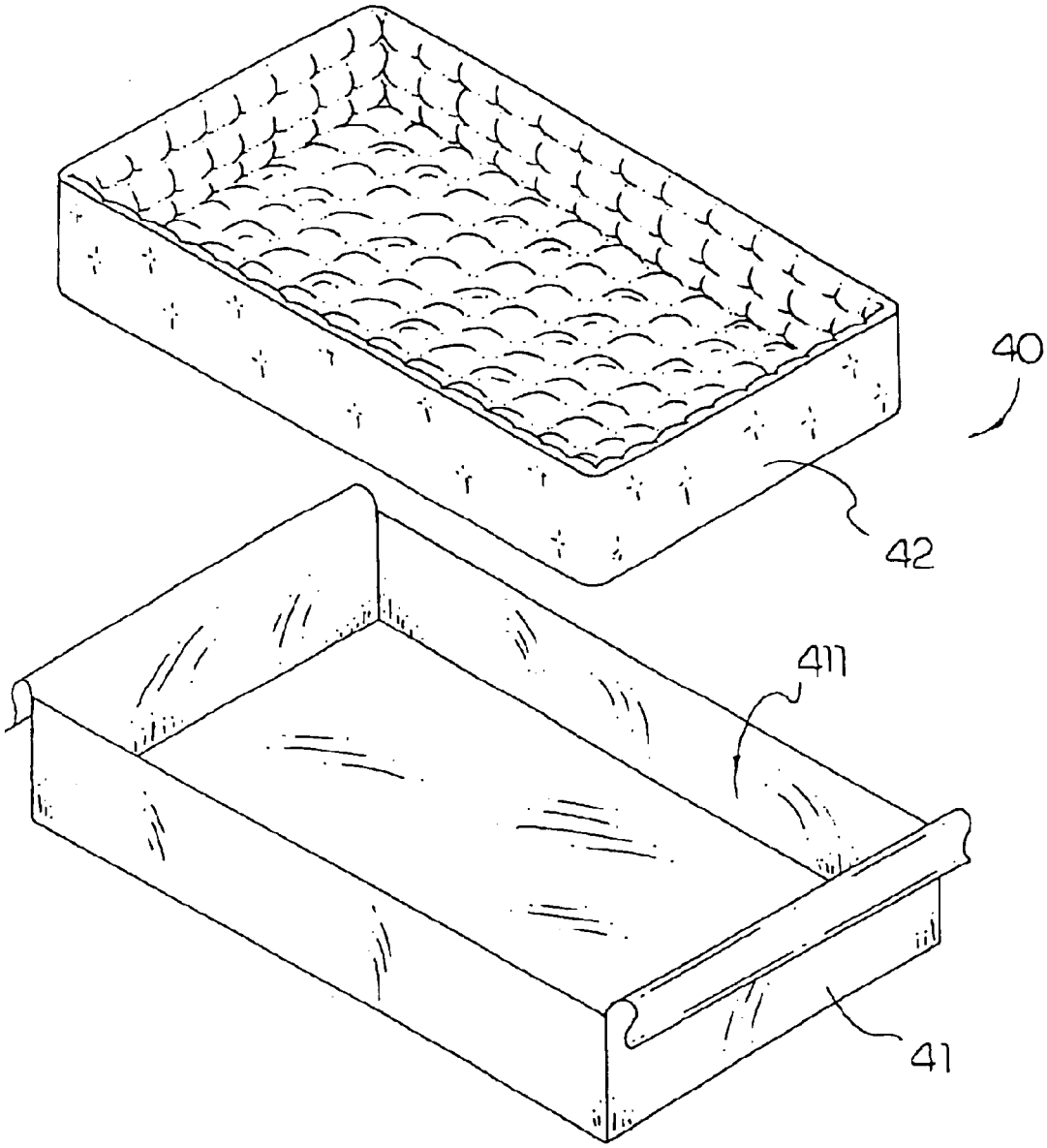
FIG. 3 is a partially exploded perspective view of the baby furniture according to the above preferred embodiment of the present invention, illustrating the structure of the bassinet.

Referring to FIG. 3 of the drawings, the bassinet frame 40 comprises a fabric boundary 41 securely supported by the second boundary frame 32 at a position by the body supporting member 20 within the bassinet cavity, wherein the fabric boundary 41 has a receiving cavity 411 formed therein and a top opening to communicate the receiving cavity 411 with outside, so that four opening rims 412 are formed along the top opening.

The bassinet frame further comprises a cushion layer 42 disposed in the receiving cavity 411 of the fabric boundary 41 so as to provide cushioning to the baby who is to be disposed in the receiving cavity 411 of the fabric boundary 41. It is worth to mention that the fabric boundary 41 further provides a secure boundary wall to the baby furniture when the baby furniture is used as the bassinet.

According to the preferred embodiment, the mounting means 50 are four mounting devices 50 provided at four comers of the second boundary frame 32 to align with the head joints 312 respectively. Accordingly, each of the supporting legs 10 has a first end fastened with the respective head joint 312 and an opposed second end, wherein the mounting devices 50 are mounted to the supporting legs 10 respectively to form the play yard portion 11 of each of the supporting legs 10 defined between the first end thereof and the mounting device 50 and the bassinet portion 12 of each of the supporting legs 10 defined between the second end thereof and the mounting device 50.

Each of the mounting devices 50 comprises a leg connector 51 outwardly and integrally protruded from the respective comer of the surrounding frame 32. Accordingly, each of the leg connector 51 has a through securing hole 511 formed thereon, wherein a diameter of each of the securing holes 511 is slightly larger or equal to an external diameter of each of the supporting legs 10. In other words, each of the supporting legs 10 is arranged to slidably pass through the securing hole 511 of the respective leg connector 51 so as to slidably fasten the body supporting member 20 to the supporting legs 10. Moreover, the mounting devices 50 further contains four engaging holes 512 transversely formed on outer sides of the four leg connectors 51 respectively, wherein each of the engaging holes 512 is capable of communicating a tubular cavity of the respective leg connector 51 with outside.

The mounting devices 50 further comprises four connecting members 52 and contains at least four transverse mounting holes 53 formed on four supporting legs 10 at the bassinet portions 12 thereof respectively, wherein each of the mounting holes 53 is formed on the respective supporting leg 10 at a position which is arranged to be coaxially aligned with the four engaging holes 512 respectively when the four supporting legs 10 are arranged to penetrate through the four leg connectors 51 while substantially supporting the baby furniture securely to stand on the ground. In other words, the body supporting member 20 is arranged to slidably move between the first and second ends of the supporting legs 10 until the leg connectors 51 are respectively slid along the supporting legs 10 through the securing holes 511 at a position that the engaging holes 512 align with the mounting holes 53 respectively so that by inserting the connecting members 52 into the mounting holes 53 through the engaging holes 512 respectively, the body supporting member 20 is retained within the supporting legs 10 in position to define the play yard cavity above the body supporting member 20 and the bassinet cavity below the body supporting member 20.

Figure 4A:
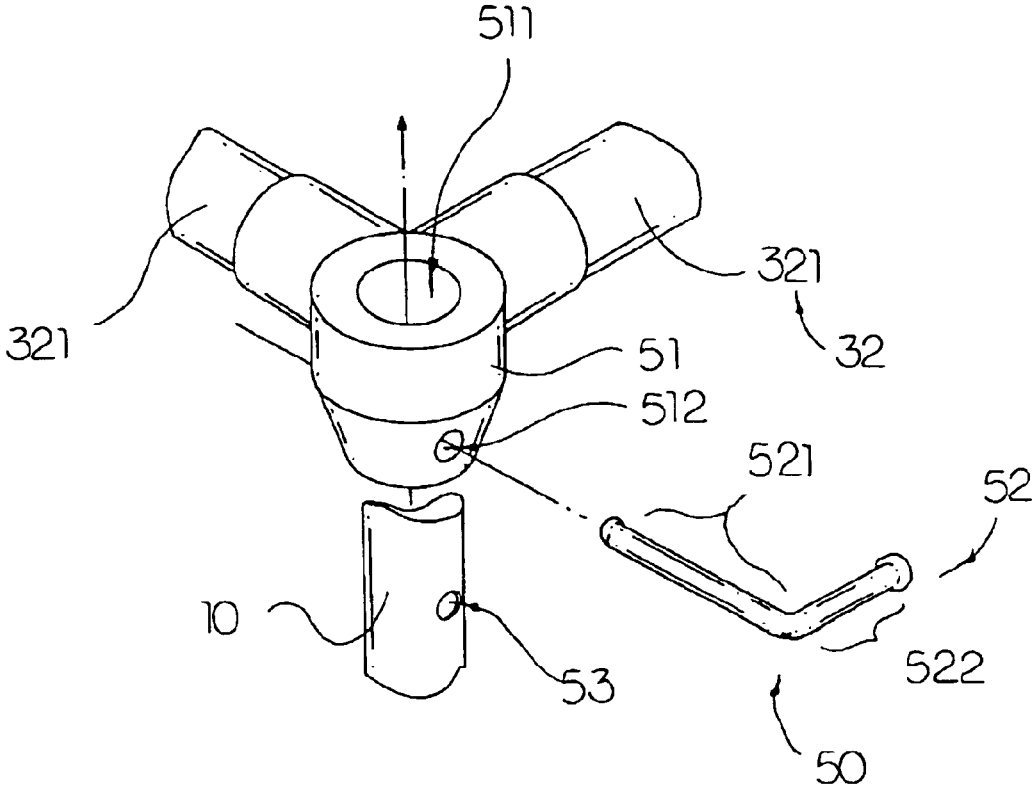
FIGS. 4A and 4B are schematic diagrams of the mounting device of the baby furniture according to the above preferred embodiment of the present invention.
Figure 4B:
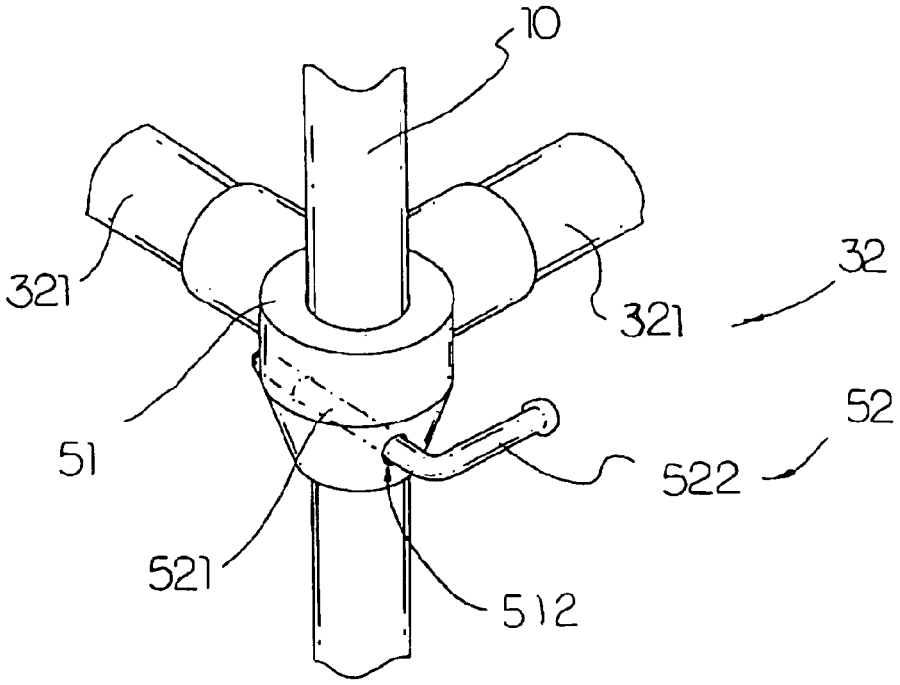

Referring to FIG. 4A of the drawings, each of the connecting members 52 is embodied as a L-shaped locking pin having a latch portion 521 and a handle portion 522, wherein each of the connecting members 52 is adapted to lock up the leg connector 51 to the respective supporting leg 10 in position while the four engaging holes 512 are coaxially aligned with the four mounting holes 53 respectively, by substantially inserting the latch portion 521 of each of the connecting members 52 into the respective mounting hole 53 through the engaging hole 512 until the handle portion 522 biasing against the leg connector 51 so as to ensure the leg connectors 51 are locked up with the supporting legs 10 respectively. At such, the supporting legs 10 are capable of securely mounting to the body supporting member 20 at four comers thereof through the surrounding frame 32 so as to substantially support it standing on the ground for use as a play yard. Alternatively, when the baby furniture is uprightly reversed, it could be utilized as a bassinet for supporting a baby.

As shown in FIG. 2, in order to further reduce the size of the baby furniture when the baby furniture is collapsed for storage and carriage, each of the supporting legs 10 has a first tubular member and a second tubular member detachably attached thereto.

It is worth to mention that the first ends of the supporting legs 10 can be adapted to engage with the four head joints 312 respectively by a variety of regular mechanism, such as screwing, in such a manner that the supporting legs 10 are capable of supporting the body supporting member 20, the play yard frame 30, and the bassinet frame 40.

Alternatively, the mounting devices 50 can be incorporated with the head joints 312 respectively, wherein the head joints 312 can be constructed as the leg connectors 51 in such a manner that additional connecting members can be utilized to slidably insert into the first ends of the supporting legs 10 through the head joints 312 so as to lock up the boundary frame 31 at the first ends of the supporting legs 10.

A trivial improvement of the above mounting devices 50 is that each of the mounting devices 50 can contain a plurality mounting holes 53 spacedly formed on each of the supporting legs 10 so that the elevation of the body supporting member 20 can be selectively adjusted by inserting the respective connecting member 52 to one of the mounting holes 53 on each supporting leg 10. In other words, the user of the present invention is able to self-adjust the depth of the play yard cavity and the depth of the bassinet cavity by sliding the body supporting member 20 between the first and second ends of the supporting legs 10 so as to suit different needs of the users in different circumstances.

As an alternative, the connecting member 52 can be embodied as a cylindrical locking pin having two ends bored. As such, each of the connecting members 52 is adapted to slidably insert into the respective mounting hole 53 and the engaging hole 512 and being locked up by regular bolt nuts.

The baby furniture further comprises four stabilizing ground stands 60 detachably mounted at the second ends of the supporting legs 10 respectively, wherein each of the stabilizing ground stands 60 has an elongated standing surface formed at a bottom side thereof for standing securely on a flat ground. Accordingly, the stabilizing ground stands 60 are axially screwed with the second ends of the supporting legs 10 to adjust a level of the body supporting member 20 with respect to the ground. Therefore, even though the ground is not evenly flat, the body supporting member 20 can be adjusted to a horizontal level by adjusting the positions of the stabilizing ground stands 60. The baby furniture further comprises four covering caps 70 detachably mounted at the first ends of the supporting legs 10 respectively for protection purpose.

It is worth to mention that when the baby furniture is used as the play yard furniture, i.e. the first ends of the supporting legs 10 are positioned above the second ends thereof, the stabilizing ground stands 60 are mounted to the second ends of the supporting legs 10 respectively while the covering caps 70 are mounted to the first ends of the supporting legs 10 respectively. When the baby furniture is used as the bassinet furniture, i.e. the second ends of the supporting legs 10 are positioned above the first ends thereof, the stabilizing ground stands 60 are mounted to the first ends of the supporting legs 10 respectively while the covering caps 70 are mounted to the second ends of the supporting legs 10 respectively.

Where the user of the present invention needs to carry or transport the baby furniture, he/she can simply disassemble the baby furniture by releasing the mounting devices to unlock the body supporting member 1 with the supporting legs 10. Then, the user is able to slidably detach the supporting legs 10 from the boundary frame 31 and the body supporting member 20 such that the body supporting member 20 is capable of folding towards the boundary frame 31 to minimize the distance therebetween so as to reduce the baby furniture to a compact structure for easy storage and carrying.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A baby furniture, comprising:

a boundary frame comprising a plurality of head joints;

a body supporting member which is spaced apart from said boundary frame, comprising a plurality of mounting devices aligned with said head joints respectively;

a plurality of supporting legs each having a first end detachably fastened with said respective head joint and an opposed second end, wherein said mounting devices are detachably mounted to said supporting legs respectively to define a play yard portion of each of said supporting legs farmed between said first end thereof and said mounting device and a bassinet portion of each of said supporting legs formed between said second end thereof and said mounting device, wherein each of said mounting devices comprises a leg connector having a through securing hole formed thereon, wherein said supporting legs are slidably passed through the securing holes of said leg connector so as to slidably mount said body supporting member to said supporting legs, wherein each of said mounting devices further contains a plurality of mounting holes formed on said supporting legs respectively and a plurality of engaging holes formed on said leg connectors to coaxially align with said mounting holes respectively, and comprises a plurality of connecting members detachably inserted into said mounting holes through said engaging holes respectively to lock up said leg connectors on said supporting legs respectively; and a boundary shelter supported by said boundary frame to surround an interior space within said supporting legs and define a play yard cavity and a bassinet cavity, wherein said play yard cavity is formed within said boundary shelter, said play yard portions of said supporting legs and said body supporting member, wherein said bassinet cavity is formed within said boundary shelter, said bassinet portions of said supporting legs and said body supporting member, wherein a depth of said play yard cavity is larger than that of said bassinet cavity, wherein when an opening of said play yard cavity faces upwardly, said baby furniture is a play yard, wherein when said baby furniture is flipped up side down to have an opening of said bassinet cavity facing upwardly, said baby furniture is a bassinet.

2. The baby furniture, as recited in claim 1, wherein each of said connecting members, having L-shaped, has a handle portion and a latch portion slidably inserting into said respective mounting hole through said engaging hole until said handle portion of said connecting member is biased against said leg connector so as to ensure said leg connectors are locked up with said supporting legs respectively.

3. The baby furniture, as recited in claim 1, wherein said mounting holes are spacedly formed along said supporting legs in such a manner that each of said leg connectors is slid along said respective supporting leg to selectively align said engaging hole with one of said mounting holes so as to selectively adjust said depth of said play yard cavity.

4. The baby furniture, as recited in claim 3, wherein each of said connecting members, having L-shaped, has a handle portion and a latch portion slidably inserting into said respective mounting hole through said engaging hole until said handle portion of said connecting member is biased against said leg connector so as to ensure said leg connectors are locked up with said supporting legs respectively.

5. The baby furniture, as recited in claim 4, wherein said boundary shelter has a first peripheral edge firmly attached to said boundary frame to form an opening rim of said play yard cavity and an opposed second peripheral edge is tensely stretched by said supporting legs to form an opening rim of said bassinet cavity.

6. The baby furniture, as recited in claim 4, further comprising a surrounding frame, wherein said mounting devices are spacedly formed on said surrounding frame and said body supporting member is supported by said supporting frame to provide a body supporting surface.

7. The baby furniture, as recited in claim 6, wherein said body supporting member is made of lightweight and durable fabric material, wherein said body supporting member is mounted on said surrounding frame and provides a tension surface as said body supporting surface for supporting a downward force of a baby user's weight.

8. The baby furniture, as recited in claim 7, wherein said boundary shelter has a first peripheral edge firmly attached to said boundary frame to form an opening rim of said play yard cavity and an opposed second peripheral edge is tensely stretched by said supporting legs to form an opening rim of said bassinet cavity.

9. The baby furniture, as recited in claim 8, further comprising a plurality of stabilizing ground stands detachably mounted on said supporting legs respectively to selectively adjust a level of said body supporting member with respect to the ground, wherein said stabilizing ground stands are coaxially attached to said first ends of said supporting legs respectively when said baby furniture is used as said play yard, and stabilizing ground stands coaxially attached to said second ends of said supporting legs respectively when said baby furniture is used as said bassinet.

10. The baby furniture, as recited in claim 7, further comprising a plurality of stabilizing ground stands detachably mounted on said supporting legs respectively to selectively adjust a level of said body supporting member with respect to the ground, wherein said stabilizing ground stands are coaxially attached to said first ends of said supporting legs respectively when said baby furniture is used as said play yard, and stabilizing ground stands coaxially attached to said second ends of said supporting legs respectively when said baby furniture is used as said bassinet.

11. The baby furniture, as recited in claim 6, further comprising a plurality of stabilizing ground stands detachably mounted on said supporting legs respectively to selectively adjust a level of said body supporting member with respect to the ground, wherein said stabilizing ground stands are coaxially attached to said first ends of said supporting legs respectively when said baby furniture is used as said play yard, and stabilizing ground stands coaxially attached to said second ends of said supporting legs respectively when said baby furniture is used as said bassinet.

12. The baby furniture, as recited in claim 3, further comprising a surrounding frame, wherein said mounting devices are spacedly formed on said surrounding frame and said body supporting member is supported by said supporting frame to provide a body supporting surface.

13. The baby furniture, as recited in claim 12, wherein said body supporting member is made of lightweight and durable fabric material, wherein said body supporting member is mounted on said surrounding frame and provides a tension surface as said body supporting surface for supporting a downward force of a baby user's weight.

14. A baby furniture, comprising:

a boundary frame comprising a plurality of head joints;

a body supporting member, which s spaced apart from said boundary frame, comprising a plurality of mounting devices aligned with said head joints respectively;

a plurality of supporting legs each having a first end detachably fastened with said respective head joint and an opposed second end, wherein said mounting devices are detachably mounted to said supporting legs respectively to define a play yard portion of each of said supporting legs formed between said first end thereof and said mounting device and a bassinet portion of each of said supporting legs formed between said second end thereof and said mounting device, wherein each of said mounting devices comprises a leg connector having a through securing hole formed thereon, wherein said supporting legs are slidably passed through the securing holes of said leg connector so as to slidably mount said body supporting member to said supporting legs;

a boundary shelter supported by said boundary frame to surround an interior space within said supporting legs and define a play yard cavity and a bassinet cavity, wherein said play yard cavity is formed within said boundary shelter, said play yard portions of said supporting legs and said body supporting member, wherein said bassinet cavity is formed within said boundary shelter, said bassinet portions of said supporting legs and said body supporting member, wherein a depth of said play yard cavity is larger than that of said bassinet cavity, wherein when an opening of said play yard cavity faces upwardly, said baby furniture is a play yard, wherein when said baby furniture is flipped up side down to have an opening of said bassinet cavity facing upwardly, said baby furniture is a bassinet; and a surrounding frame, wherein said mounting devices are spacedly formed on said surrounding frame and said body supporting member is supported by said supporting frame to provide a body supporting surface.

15. The baby furniture, as recited in claim 14, wherein said body supporting member is made of lightweight and durable fabric material, wherein said body supporting member is mounted on said surrounding frame and provides a tension surface as said body supporting surface for supporting a downward force of a baby user's weight.

* * * * *